US006003743A

United States Patent [19]

Deady

[11] Patent Number: 6,003,743

[45] Date of Patent: Dec. 21, 1999

[54] MULTIPLE ITEM ADJUSTABLE CLOTHES HANGER

[76] Inventor: John J. Deady, 5623 W. Luebbe La., Milwaukee, Wis. 53223

[21] Appl. No.: 09/296,319

[22] Filed: Apr. 22, 1999

[51] Int. Cl.[6] ..... A47G 25/48

[52] U.S. Cl. ..... 223/96; 223/95

[58] Field of Search ..... 223/96, 95, 85, 223/81, 91

[56] References Cited

U.S. PATENT DOCUMENTS

| | | | |
|---|---|---|---|
| 2,209,864 | 7/1940 | Warren | 223/96 |
| 2,221,978 | 8/1940 | Deknatel | 223/96 |
| 3,010,626 | 11/1961 | Crockett, Jr. | 223/96 |
| 3,197,095 | 7/1965 | Swanson | 223/96 |
| 5,249,719 | 10/1993 | Hulyk | 223/96 |

*Primary Examiner*—Bibhu Mohanty

[57] ABSTRACT

A multiple item adjustable clothes hanger for simultaneously hanging one or more articles of clothing, such as pants, skirts and jackets, for storage and transport. The multiple item adjustable clothes hanger includes elongate first and second clamping jaws pivotally coupled together and adapted for pinching clothing therebetween. A clamping system provides lockage of clamping of the first clamping jaw with respect to the second clamping jaw in first, second, and third positions. The clamping system includes a lever and an adjustment sleeve. The adjustment sleeve has first, second, and third channels extending therearound. The first channel has a greater circumference than the second channel. The second channel has a greater circumference than the third channel. The lever is moved to a particular channel, by the owner, depending on the thickness of the garment materials to be held between the clamping jaws.

9 Claims, 3 Drawing Sheets

MULTIPLE ITEM ADJUSTABLE CLOTHES HANGER

BACKGROUND OF THE INVENTION

1. Field of the Invention

The present invention relates to clothes hangers and more particularly pertains to a new multiple item adjustable clothes hanger for simultaneously hanging multiple items of clothing such as pants, skirts and jackets for storage and transport.

2. Description of the Prior Art

The use of clothes hangers is known in the prior art. More specifically, clothes hangers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,048,312; U.S. Pat. No. 5,249,719; U.S. Pat. No. 3,744,686; U.S. Pat. No. 2,212,978; U.S. Pat. No. Des. 323,247; and U.S. Pat. No. 4,022,360.

While these devices fulfill their respective, particular objectives and requirements, the aforementioned patents do not disclose a new multiple item adjustable clothes hanger. The inventive device includes elongate first and second clamping jaws pivotally coupled together and adapted for pinching clothing therebetween. A clamping system provides lockage of clamping of the first clamping jaw with respect to the second clamping jaw in first, second, and third positions. The clamping system includes a lever and an adjustment sleeve. The adjustment sleeve has first, second, and third channels extending therearound. The first channel has a greater circumference than the second channel, the second channel has a greater circumference than the third channel. The lever engages a particular channel of the adjustment sleeve, as selected by the owner, depending on the thickness of the garment or garments to be held between the clamping jaws.

In these respects, the multiple item adjustable clothes hanger according to the present invention substantially departs from the conventional concepts and designs of the prior art, and in so doing provides an apparatus primarily developed for the purpose of hanging clothing such as pants, skirts and jackets for storage and transport.

SUMMARY OF THE INVENTION

In view of the foregoing disadvantages inherent in the known types of clothes hangers now present in the prior art, the present invention provides a new multiple item adjustable clothes hanger construction wherein the same can be utilized for hanging clothing such as pants, skirts and jackets for storage and transport.

The general purpose of the present invention, which will be described subsequently in greater detail, is to provide a new multiple item adjustable clothes hanger apparatus and method which has many of the advantages of the clothes hangers mentioned heretofore and many novel features that result in a new multiple item adjustable clothes hanger which is not anticipated, rendered obvious, suggested, or even implied by any of the prior art clothes hangers, either alone or in any combination thereof.

To attain this, the present invention generally comprises elongate first and second clamping jaws pivotally coupled together and adapted for pinching clothing therebetween. A clamping system provides lockage of clamping of the first clamping jaw with respect to the second clamping jaw in first, second, and third positions. The clamping system includes a lever and an adjustment sleeve. The adjustment sleeve has first, second, and third channels extending therearound. The first channel has a greater circumference than the second channel, the second channel has a greater circumference than the third channel. The lever engages a particular channel of the adjustment sleeve, as selected by the owner, depending on the thickness of the garment or garments to be held between the clamping jaws.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple item adjustable clothes hanger apparatus and method which has many of the advantages of the clothes hangers mentioned heretofore and many novel features that result in a new multiple item adjustable clothes hanger which is not anticipated, rendered obvious, suggested, or even implied by any of the prior art clothes hangers, either alone or in any combination thereof.

It is another object of the present invention to provide a new multiple item adjustable clothes hanger which may be easily and efficiently manufactured and marketed.

It is a further object of the present invention to provide a new multiple item adjustable clothes hanger which is of a durable and reliable construction.

An even further object of the present invention is to provide a new multiple item adjustable clothes hanger which is susceptible of a low cost of manufacture with regard to both materials and labor, and which accordingly is then susceptible of low prices of sale to the consuming public, thereby making such multiple item adjustable clothes hanger economically available to the buying public.

Still yet another object of the present invention is to provide a new multiple item adjustable clothes hanger which provides in the apparatuses and methods of the prior art some of the advantages thereof, while simultaneously overcoming some of the disadvantages normally associated therewith.

Still another object of the present invention is to provide a new multiple item adjustable clothes hanger for hanging clothing such as pants, skirts and jackets for storage and transport.

Yet another object of the present invention is to provide a new multiple item adjustable clothes hanger which includes elongate first and second clamping jaws pivotally coupled together and adapted for pinching clothing therebetween. A clamping system provides lockage of clamping of the first clamping jaw with respect to the second clamping jaw in first, second, and third positions. The clamping system includes a lever and an adjustment sleeve. The adjustment sleeve has first, second, and third channels extending therearound. The first channel has a greater circumference than the second channel, the second channel has a greater circumference than the third channel. The lever engages a particular channel of the adjustment sleeve, as selected by the owner, depending on the thickness of the garment or garments to be held between the clamping jaws.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
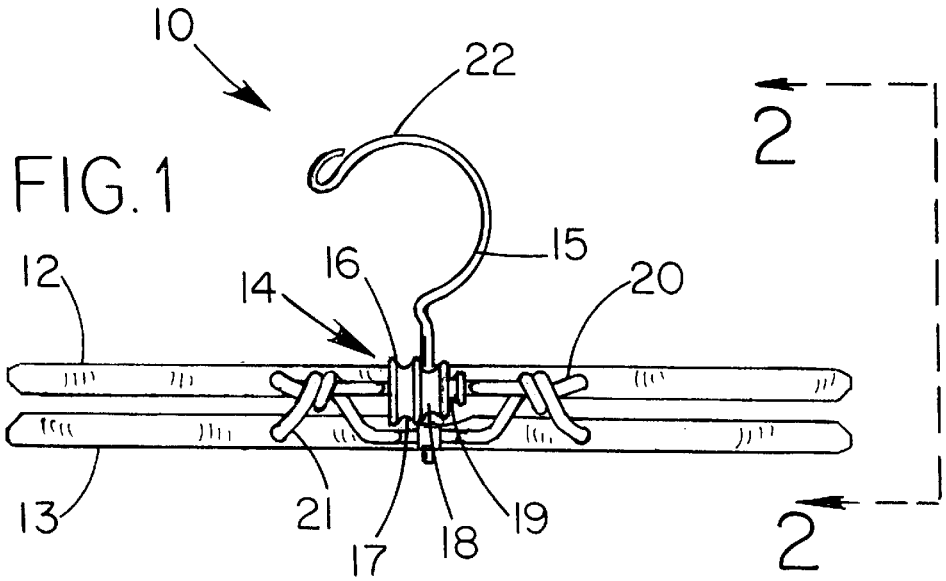
FIG. 1 is a schematic top view of a new multiple item adjustable clothes hanger according to the present invention.
Figure 2:
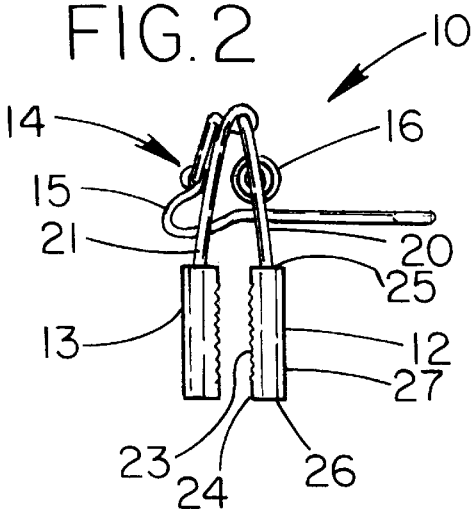
FIG. 2 is a schematic side view of the present invention.
Figure 3:
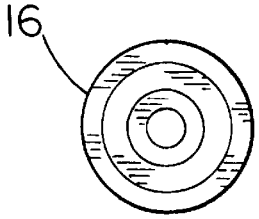
FIG. 3 is a schematic side view of an adjustment sleeve of the present invention.
Figure 4:
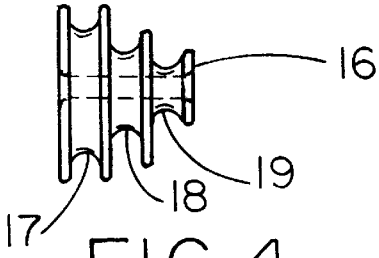
FIG. 4 is a schematic front view of the adjustment sleeve of the present invention.
Figure 5:
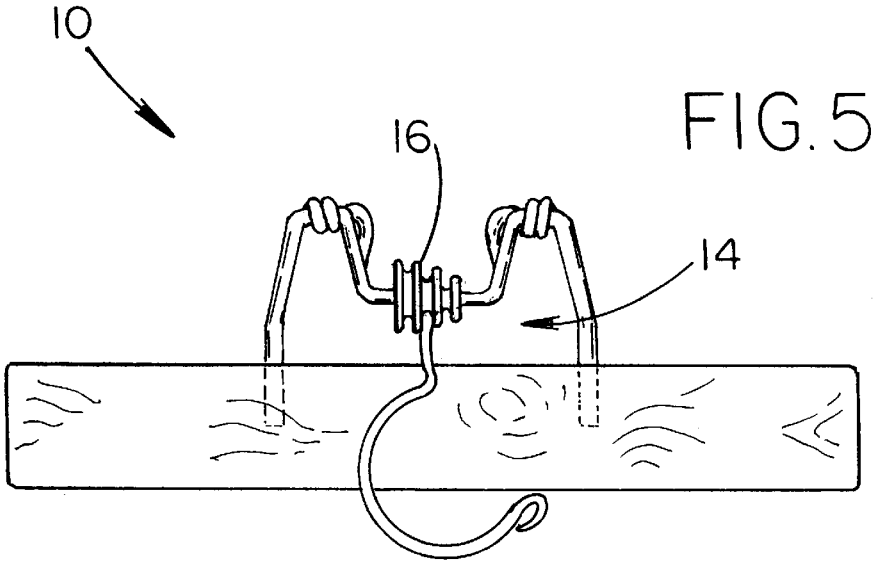
FIG. 5 is a schematic front view of the present invention.

With reference now to the drawings, and in particular to FIGS. 1 through 8 thereof, a new multiple item adjustable clothes hanger embodying the principles and concepts of the present invention and generally designated by the reference numeral 10 will be described.

As best illustrated in FIGS. 1 through 5 and 8, the multiple item adjustable clothes hanger 10 generally comprises elongate first and second clamping jaws 12,13 pivotally coupled together and adapted for pinching clothing therebetween. A clamping system 14 provides lockage of clamping of the first clamping jaw with respect to the second clamping jaw in first, second, and third positions. The clamping system includes a lever 15 and an adjustment sleeve 16. The adjustment sleeve has first, second, and third channels 17,18,19 extending therearound. The first channel has a greater circumference than the second channel. The second channel has a greater circumference than the third channel. The lever engages a particular channel of the adjustment sleeve, as selected by the owner, depending on the thickness of the garment or garments to be held between the clamping jaws Preferably, the first clamping jaw has a generally U-shaped first coupling member 20 extending therefrom. The second clamping jaw has a generally U-shaped second coupling member 21 extending therefrom that is pivotally coupled to the first coupling member.

The adjustment sleeve is slidably disposed around the first coupling member. The lever is pivotally coupled to the second coupling member for pinchably engaging the channels of the adjustment sleeve for providing lockage of clamping of the first clamping jaw with respect to the second clamping jaw. The lever should only pivot. It should not slide with respect to the second coupling member. This maintains the hanger's balance.

The lever is positioned in the first channel of the adjustment sleeve, by the owner, when a thickness of garments placed between the clamping jaws is less than a first predetermined thickness. The lever is positioned in the second channel of the adjustment sleeve, by the owner, when a thickness of garments placed between the clamping jaws is less than a second predetermined thickness and greater than the first predetermined thickness. The lever is positioned in the third channel of the adjustment sleeve, by the owner, when a thickness of garments placed between the clamping jaws is less than a third predetermined thickness and greater than the second predetermined thickness.

Preferably, the lever has an arcuate portion 22 towards a free end thereof to permit hanging of the first hanger on an object such as a hook or rod.

Also preferably, each of the clamping jaws has a plurality of generally V-shaped grooves 23 extending into inner faces 24 thereof along the longitudinal axes of the clamping jaws for frictionally engaging clothing. The preferred depth of the grooves is about 1/16 inch so that the ridges formed by the grooves do not crease the garments they engage.

The preferred length of each of the clamping jaws along its longitudinal axis is between about 8 to 12 inches. The width of each jaw between its upper and lower edges 25,26 is about 1⅜ inches. The width of each jaw between its inner and outer faces 24,27 is about ⅜ inches. The inner face of each clamping jaw at the center is grooved out to allow pants seams to lay smoothly at that point without being crushed by the pressure of the clamping forces.

Figure 6:
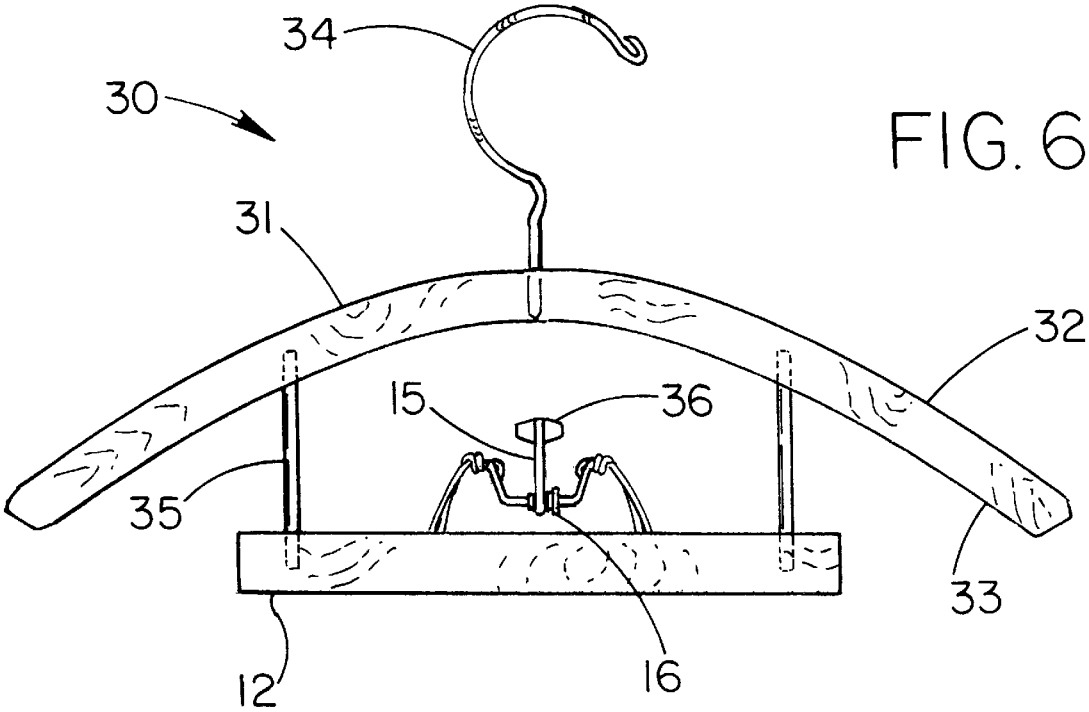
FIG. 6 is a schematic front view of an alternate embodiment of the present invention.
Figure 7:
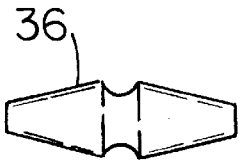
FIG. 7 is a schematic front view of a handle of the alternate embodiment of the present invention.
Figure 8:
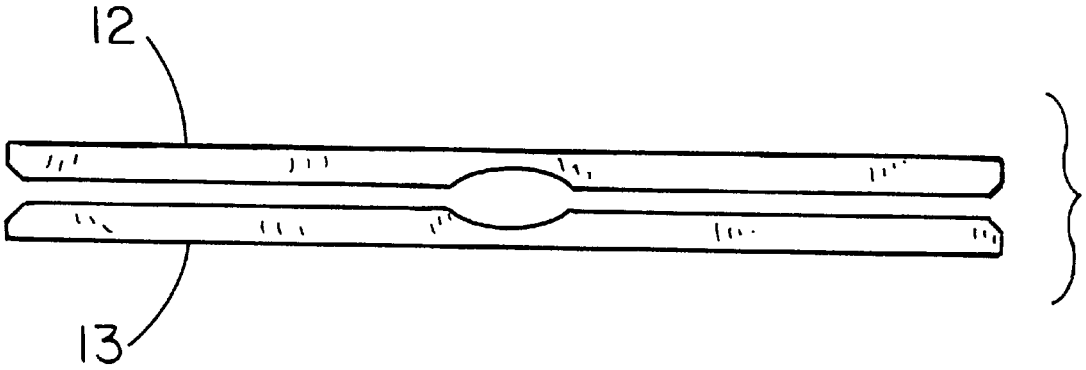
FIG. 8 is a schematic bottom view of the present invention.

In an alternate embodiment 30, shown in FIGS. 6 and 7, the invention includes an elongate arcuate hanger portion 31 with upper and lower edges 32,33 and a hook 34 extending from the upper surface thereof. The hanger portion curves away from the hook.

Elongate first and second clamping jaws are pivotally coupled together and adapted for pinching clothing therebetween. Preferably, a pair of rods 35 extend from the lower surface of the hanger portion to one of the clamping jaws for coupling the clamping jaw to the hanger portion.

A clamping system provides lockage of clamping of the first clamping jaw with respect to the second clamping jaw in first, second, and third positions. The clamping system includes a lever and an adjustment sleeve. The adjustment sleeve has first, second, and third channels extending therearound, the first channel has a greater circumference than the second channel, the second channel has a greater circumference than the third channel. The lever engages a particular channel of the adjustment sleeve, as selected by the owner, depending on the thickness of the garment or garments to be held between the clamping jaws Preferably, the first clamping jaw has a generally U-shaped first coupling member extending therefrom. The second clamping jaw has a generally U-shaped second coupling member extending therefrom that is pivotally coupled to the first coupling member.

The adjustment sleeve is slidably disposed around the first coupling member. The lever pivotally coupled to the second coupling member for pinchably engaging the channels of the adjustment sleeve for providing lockage of clamping of the first clamping jaw with respect to the second clamping jaw. The lever should only pivot. It should not slide with respect to the second coupling member. This maintains the hanger's balance.

The lever is positioned in the first channel of the adjustment sleeve, by the owner, when a thickness of garments placed between the clamping jaws is less than a first predetermined thickness. The lever is positioned in the second channel of the adjustment sleeve, by the owner, when a thickness of garments placed between the clamping jaws is less than a second predetermined thickness and greater than the first predetermined thickness. The lever is positioned in the third channel of the adjustment sleeve, by the owner, when a thickness of garments placed between the clamping jaws is less than a third predetermined thickness and greater than the second predetermined thickness.

Preferably, the lever has a handle portion 36 coupled to a free end thereof to permit easier grasping of the lever to lock and unlock the clamping jaws.

Also preferably, each of the clamping jaws has a plurality of generally V-shaped grooves extending into inner faces thereof along the longitudinal axes of the clamping jaws for frictionally engaging clothing. The preferred depth of the grooves is about 1/16 inch so that the ridges formed by the grooves do not crease the garments they engage.

The preferred length of each of the clamping jaws along its longitudinal axis is between about 8 to 12 inches. The width of each jaw between its upper and lower edges is about 1 3/8 inches. The width of each jaw between its inner and outer faces is about 3/8 inches. The inner face of each clamping jaw at the center is grooved out to allow pants seams to lay smoothly at that point without being crushed by the pressure of the clamping forces.

In use, one or a plurality of garments are placed between the clamping jaws. The desired channel of the adjustment sleeve is chosen by the owner and is aligned with the lever depending on the thickness of the garments between the clamping jaws. For example, the adjustment sleeve may be dimensioned such that the lever engages the first channel when one pair of pants or one skirt is positioned between the clamping jaws. The lever may engage the second channel when the owner chooses to place two pairs of pants or skirts between the clamping jaws. The lever may engage the third channel when the owner chooses to position three pairs of pants or skirts between the clamping jaws.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hanger for clothing, comprising:

elongate first and second clamping jaws being pivotally coupled together and adapted for pinching clothing therebetween;

a clamping system for providing lockage of clamping of said first clamping jaw with respect to said second clamping jaw in first, second, and third positions;

said clamping system having a lever and an adjustment sleeve;

said adjustment sleeve having first, second, and third channels extending therearound, said first channel having a greater circumference than said second channel, said second channel having a greater circumference than said third channel; and wherein said lever is positioned in said first channel of said adjustment sleeve when a thickness of garments placed between said clamping jaws is less than a first predetermined thickness, said lever being positioned in said second channel of said adjustment sleeve when a thickness of garments placed between said clamping jaws is less than a second predetermined thickness and greater than said first predetermined thickness, said lever being positioned in said third channel of said adjustment sleeve when a thickness of garments placed between said clamping jaws is less than a third predetermined thickness and greater than said second predetermined thickness.

2. The hanger for clothing of claim 1, wherein said first clamping jaw has a generally U-shaped first coupling member extending therefrom, said second clamping jaw having a generally U-shaped second coupling member extending therefrom and being pivotally coupled to said first coupling member, said adjustment sleeve being slidably disposed around said first coupling member.

3. The hanger of claim 2, wherein said lever is pivotally coupled to said second coupling member.

4. The hanger of claim 3, wherein said lever has an arcuate portion towards a free end thereof.

5. The hanger of claim 2, wherein each of the clamping jaws has a plurality of generally V-shaped grooves extending into inner faces thereof for frictionally engaging clothing.

6. A hanger for clothing, comprising:

an elongate arcuate hanger portion having upper and lower edges and a hook extending from said upper surface thereof, said hanger portion curving away from said hook thereof;

elongate first and second clamping jaws being pivotally coupled together and adapted for pinching clothing therebetween, one of said clamping jaws being coupled to said hanger portion;

a clamping system for providing lockage of clamping of said first clamping jaw with respect to said second clamping jaw in first, second, and third positions;

said clamping system having a lever and an adjustment sleeve;

said adjustment sleeve having first, second, and third channels extending therearound, said first channel having a greater circumference than said second channel, said second channel having a greater circumference than said third channel; and wherein said lever is positioned in said first channel of said adjustment sleeve when a thickness of garments placed between said clamping jaws is less than a first predetermined thickness, said lever being positioned in said second channel of said adjustment sleeve when a thickness of garments placed between said clamping jaws is less than a second predetermined thickness and greater than said first predetermined thickness, said lever being positioned in said third channel of said adjustment sleeve when a thickness of garments placed between said clamping jaws is less than a third predetermined thickness and greater than said second predetermined thickness.

7. The hanger of claim 6, wherein a pair of rods extend from said lower surface of said hanger portion to one of said clamping jaws for coupling said clamping jaw to said hanger portion.

8. The hanger of claim 6, wherein said lever has a handle portion coupled to a free end thereof.

9. A hanging system for clothing, comprising in combination:

a first hanger, comprising:

elongate first and second clamping jaws being pivotally coupled together and adapted for pinching clothing therebetween;

said first clamping jaw having a generally U-shaped first coupling member extending therefrom;

said second clamping jaw having a generally U-shaped second coupling member extending therefrom and being pivotally coupled to said first coupling member;

said first coupling member having an adjustment sleeve slidably disposed therearound, said adjustment sleeve having first, second, and third channels extending therearound, said first channel having a greater circumference than said second channel, said second channel having a greater circumference than said third channel;

a lever pivotally coupled to said second coupling member for pinchably engaging said channels of said adjustment sleeve for providing lockage of clamping of said first clamping jaw with respect to said second clamping jaw;

wherein said lever is positioned in said first channel of said adjustment sleeve when a thickness of garments placed between said clamping jaws is less than a first predetermined thickness, said lever being positioned in said second channel of said adjustment sleeve when a thickness of garments placed between said clamping jaws is less than a second predetermined thickness and greater than said first predetermined thickness, said lever being positioned in said third channel of said adjustment sleeve when a thickness of garments placed between said clamping jaws is less than a third predetermined thickness and greater than said second predetermined thickness;

said lever having an arcuate portion towards a free end thereof;

each of the clamping jaws having a plurality of generally V-shaped grooves extending into inner faces thereof for frictionally engaging clothing; and a second hanger, comprising:

an elongate arcuate hanger portion having upper and lower edges and a hook extending from said upper surface thereof, said hanger portion curving away from said hook thereof;

elongate first and second clamping jaws being pivotally coupled together and adapted for pinching clothing therebetween;

a pair of rods extending from said lower surface of said hanger portion to one of said clamping jaws for coupling said clamping jaw to said hanger portion;

said first clamping jaw having a generally U-shaped first coupling member extending therefrom;

said second clamping jaw having a generally U-shaped second coupling member extending therefrom and being pivotally coupled to said first coupling member;

said first coupling member having an adjustment sleeve slidably disposed therearound, said adjustment sleeve having first, second, and third channels extending therearound, said first channel having a greater circumference than said second channel, said second channel having a greater circumference than said third channel;

a lever pivotally coupled to said second coupling member for pinchably engaging said channels of said adjustment sleeve for providing lockage of clamping of said first clamping jaw with respect to said second clamping jaw;

wherein said lever is positioned in said first channel of said adjustment sleeve when a thickness of garments placed between said clamping jaws is less than a first predetermined thickness, said lever being positioned in said second channel of said adjustment sleeve when a thickness of garments placed between said clamping jaws is less than a second predetermined thickness and greater than said first predetermined thickness, said lever being positioned in said third channel of said adjustment sleeve when a thickness of garments placed between said clamping jaws is less than a third predetermined thickness and greater than said second predetermined thickness;

said lever having a handle portion coupled to a free end thereof; and each of the clamping jaws having a plurality of generally V-shaped grooves extending into inner faces thereof for frictionally engaging clothing.

* * * * *